US011624356B2

(12) United States Patent
King

(10) Patent No.: US 11,624,356 B2
(45) Date of Patent: Apr. 11, 2023

(54) GAS TRANSPORT AND PRESSURIZATION SYSTEM

(71) Applicant: John B. King, Lockport, NY (US)

(72) Inventor: John B. King, Lockport, NY (US)

( * ) Notice: Subject to any disclaimer, the term of this patent is extended or adjusted under 35 U.S.C. 154(b) by 177 days.

(21) Appl. No.: 17/173,442

(22) Filed: Feb. 11, 2021

(65) Prior Publication Data

US 2022/0252060 A1 Aug. 11, 2022

(51) Int. Cl.
*F04B 39/00* (2006.01)
*F04B 39/12* (2006.01)
*E21B 43/12* (2006.01)

(52) U.S. Cl.
CPC ..... *F04B 39/0016* (2013.01); *F04B 39/128* (2013.01); *E21B 43/122* (2013.01); *F04B 39/0094* (2013.01)

(58) Field of Classification Search
CPC F04B 39/0016; F04B 39/128; F04B 39/0094; F04B 35/01; F04B 39/10; E21B 43/122
USPC ..... 417/255
See application file for complete search history.

(56) References Cited

U.S. PATENT DOCUMENTS 898,659 A * 9/1908 Kuehl ..... F04B 39/0016 417/259
1,109,154 A * 9/1914 Thomas ..... F04B 39/128 92/169.1
1,329,559 A 2/1920 Telsa
1,445,073 A * 2/1923 Corpl ..... F04B 39/1013 417/242
1,795,445 A * 3/1931 Walter ..... F04B 39/128 417/439
1,831,976 A * 11/1931 Stow ..... F04B 35/008 417/349
1,838,148 A * 12/1931 Lundgaard ..... F25B 31/002 417/498
1,891,083 A * 12/1932 Adiely ..... F04B 39/128 417/242
1,937,541 A * 12/1933 Alkman ..... F04B 39/128 92/158
2,084,665 A * 6/1937 Aikman ..... F04B 49/24 417/299
2,150,487 A * 3/1939 Brown ..... F04B 39/0016 62/468
RE21,196 E * 9/1939 Guild ..... F04B 39/127 417/255
3,338,509 A * 8/1967 Mcaninch ..... F04B 39/08 417/242

(Continued)

FOREIGN PATENT DOCUMENTS

CN 203308672 11/2013
CN 203488988 3/2014

(Continued)

*Primary Examiner* — Kenneth J Hansen
*Assistant Examiner* — Benjamin Doyle
(74) *Attorney, Agent, or Firm* — Harter Secrest & Emery LLP; Michael Nicolas Vranjes

(57) ABSTRACT

A gas transport and pressurization system, including a static valve, a compartment concentrically arranged around the static valve, a dynamic valve axially displaceable relative to the static valve, and a crankshaft connected to the dynamic valve, wherein gas from a ground gas well flows through the compartment, the dynamic valve, and the static valve to a gas outlet.

20 Claims, 4 Drawing Sheets

(56) References Cited

U.S. PATENT DOCUMENTS

| | | | | | |
|---|---|---|---|---|---|
| 4,059,367 | A * | 11/1977 | Marshall | F04B 27/005 | 417/529 |
| 4,275,999 | A * | 6/1981 | Hetzel | F04B 39/0016 | 417/299 |
| 4,391,568 | A * | 7/1983 | Tenney | F04B 41/04 | 165/125 |
| 6,666,656 | B2 * | 12/2003 | Pressel | F04B 39/0016 | 417/295 |
| 8,549,877 | B2 | 10/2013 | Santos | | |
| 9,938,967 | B2 * | 4/2018 | Ignatiev | F04B 25/005 | |
| 2004/0228737 | A1 * | 11/2004 | Folchert | F04B 25/02 | 417/415 |
| 2007/0041847 | A1 * | 2/2007 | Inoue | F04B 39/066 | 417/269 |
| 2009/0047159 | A1 * | 2/2009 | Inoue | F04B 25/00 | 417/521 |
| 2016/0208790 | A1 * | 7/2016 | Bhakta | F04B 35/045 | |
| 2018/0163711 | A1 * | 6/2018 | Follmar | F04B 39/00 | |
| 2019/0345923 | A1 * | 11/2019 | McCoy | F04B 35/01 | |

FOREIGN PATENT DOCUMENTS

| | | | |
|---|---|---|---|
| CN | 203656578 | | 6/2014 |
| CN | 108035863 | A * | 5/2018 |
| CN | 109681780 | | 4/2019 |
| CN | 110259661 | A * | 9/2019 |
| CN | 210567552 | | 5/2020 |

* cited by examiner

GAS TRANSPORT AND PRESSURIZATION SYSTEM

FIELD

The present disclosure relates to the field gas transport and pressurization, and more particularly, to a gas transport and pressurization system that self-regulates the temperature of pressurized gas.

BACKGROUND

Natural gas or fossil gas, or sometimes called just gas, is a naturally occurring hydrocarbon gas mixture consisting primarily of methane, but commonly including varying amounts of other higher alkanes, and sometimes a small percentage of carbon dioxide, nitrogen, hydrogen sulfide, or helium. It is formed when layers of decomposing plant and animal matter are exposed to intense heat and pressure under the surface of the Earth over millions of years. The energy that the plants originally obtained from the sun is stored in the form of chemical bonds in the gas. Natural gas is a fossil fuel. Natural gas is sometimes informally referred to simply as "gas," especially when it is being compared to other energy sources, such as oil or coal. However, it is not to be confused with gasoline, which is often shortened in colloquial usage to "gas," especially in North America.

Natural gas is a non-renewable hydrocarbon used as a source of energy for heating, cooking, and electricity generation. It is also used as a fuel for vehicles and as a chemical feedstock in the manufacture of plastics and other commercially important organic chemicals.

The mining and consumption of natural gas is a major and growing driver of climate change. It is a potent greenhouse gas itself when released into the atmosphere, and creates carbon dioxide during oxidation. Natural gas can be efficiently burned to generate heat and electricity; emitting less waste and toxins at the point of use relative to other fossil and biomass fuels. However, gas venting and flaring, along with unintended fugitive emissions throughout the supply chain, can result in a similar carbon footprint overall.

Natural gas is found in deep underground rock formations or associated with other hydrocarbon reservoirs in coal beds and as methane clathrates. Petroleum is another resource and fossil fuel found close to and with natural gas. Most natural gas was created over time by two mechanisms: biogenic and thermogenic. Biogenic gas is created by methanogenic organisms in marshes, bogs, landfills, and shallow sediments. Deeper in the earth, at greater temperature and pressure, thermogenic gas is created from buried organic material.

In petroleum production, gas is sometimes burned as flare gas. Before natural gas can be used as a fuel, most, but not all, must be processed to remove impurities, including water, to meet the specifications of marketable natural gas. The by-products of this processing include ethane, propane, butanes, pentanes, and higher molecular weight hydrocarbons, hydrogen sulfide (which may be converted into pure sulfur), carbon dioxide, water vapor, and sometimes helium and nitrogen.

Therefore, there is a long-felt need for a system that transports gas extracted from the ground without releasing it into the atmosphere. There is also a long-felt need for a system that pressurizes gas extracted from the ground such that it can be stored more efficiently or pumped to a down stream storage container or facility (e.g., loaded into a truck or tank). There is also a long-felt need for a system that can self-regulate the extremely high gas temperatures created by the pressurization process.

SUMMARY

According to aspects illustrated herein, there is provided a gas transport and pressurization system, comprising a static valve, a compartment concentrically arranged around the static valve, a dynamic valve axially displaceable relative to the static valve, and a crankshaft connected to the dynamic valve, wherein gas from a ground gas well flows through the compartment, the dynamic valve, and the static valve to a gas outlet.

In some embodiments, the gas transport and pressurization system further comprises a cylinder, the dynamic valve being sealingly and slidingly engaged in the cylinder. In some embodiments, the dynamic valve allows gas flow therethrough in a first direction, but not a second direction. In some embodiments, the static valve allows gas flow therethrough in the first direction, but not the second direction. In some embodiments, the gas transport and pressurization system further comprises a crankcase connected to the cylinder, the crankshaft being arranged in the crankcase, wherein the gas flows through the crankcase prior to entering the dynamic valve. In some embodiments, the gas transport and pressurization system further comprises a hydraulic motor connected to the crankshaft, the hydraulic motor operatively arranged to rotate the crankshaft and reciprocate the dynamic piston in a first direction and a second direction, opposite the first direction. In some embodiments, when the dynamic valve is displaced in the first direction gas in the cylinder is forced into the static valve and gas from the compartment is pulled into the crankcase, and when the dynamic valve is displaced in the second direction, gas from the crankcase is forced into the dynamic valve. In some embodiments, the gas transport and pressurization system further comprises a first control valve fluidly arranged between the compartment and the crankcase, the first control valve operatively arranged to regulate the flow of gas therethrough. In some embodiments, the gas transport and pressurization system further comprises a second control valve fluidly arranged between a second stage gas inlet and the crankcase, the second control valve operatively arranged to regulate flow of gas therethrough. In some embodiments, each of the static valve and the dynamic valve comprises at least one valvular conduit. In some embodiments, the gas transport and pressurization system further comprises a temperature sensor and transmitter arranged on at least one of an outlet of the compartment and an outlet of the static valve.

According to aspects illustrated herein, there is provided a gas transport and pressurization system, comprising a static valve, a compartment concentrically arranged around the static valve, a cylinder connected to the static valve, a dynamic valve sealingly and slidingly engaged in the cylinder, the dynamic valve axially displaceable relative to the static valve, a crankcase connected to the cylinder, and a crankshaft arranged in the crankcase and connected to the dynamic valve, wherein gas from a ground gas well flows through the compartment, the crankcase, the dynamic valve, and the static valve to a gas outlet. In some embodiments, the dynamic valve allows gas flow therethrough in a first direction, but not a second direction. In some embodiments, the static valve allows gas flow therethrough in the first direction, but not the second direction. In some embodiments, the gas transport and pressurization system further comprises a hydraulic motor connected to the crankshaft, the hydraulic motor operatively arranged to rotate the crankshaft and reciprocate the dynamic piston in a first direction and a second direction, opposite the first direction. In some embodiments, when the dynamic valve is displaced in the first direction, gas in the cylinder is forced into the static valve and gas from the compartment is pulled into the crankcase, and when the dynamic valve is displaced in the second direction, gas from the crankcase is forced into the dynamic valve. In some embodiments, the gas transport and pressurization system further comprises a first control valve fluidly arranged between the compartment and the crankcase, the first control valve operatively arranged to regulate the flow of gas therethrough. In some embodiments, the gas transport and pressurization system further comprises a second control valve fluidly arranged between a second stage gas inlet and the crankcase, the second control valve operatively arranged to regulate flow of gas therethrough. In some embodiments, each of the static valve and the dynamic valve comprises at least one valvular conduit.

According to aspects illustrated herein, there is provided a gas transport and pressurization system, comprising a static valve, a compartment concentrically arranged around the static valve, a cylinder connected to the static valve, a piston sealingly and slidingly engaged in the cylinder, a dynamic valve connected to the piston, wherein the piston and the dynamic valve are axially displaceable relative to the static valve, a crankcase connected to the cylinder, a crankshaft arranged in the crankcase and connected to the dynamic valve, and a hydraulic motor connected to the crankshaft and operatively arranged to rotate the crankshaft and reciprocate the dynamic piston in a first direction and a second direction, opposite the first direction, wherein gas from a ground gas well flows through the compartment, the crankcase, the dynamic valve, and the static valve to a gas outlet.

According to aspects illustrated herein, there is provided a gas transport and pressurization system that includes a ram. The assembly is a manifolded gas conduit with an integral ram type gas transport system. The transport system comprises of a reciprocating-type assembly including a crankshaft, connecting piston rod, and piston rotating gear. The piston is coupled with a cartridge incorporating an impingement loop check valve. The piston is fitted with seal rings and the cartridge rides in a linear bearing. The crankshaft is powdered by a hydraulic motor that is contained inside the gas conduit. The head or forward section comprises a double wall conduit that houses a second static impingement loop check valve in the center thereof and a gas flow conduit in the double wall conduit or jacket. The inlet gas is run first through the jacket and then fed through the pressure rated crankcase. This cools the gas within the static impingement loop check valve. The flow of inlet gas takes a path through the center of the pump or piston and is moved along by the reciprocating action of the rotating gear, or reciprocating dynamic impingement loop check valve. Lube oil is fed through the conduit wall at the linear bearing location and below the oil ring at the piston. The gas transport and pressurization system may further comprise a plurality of control valves. Gas transport and pressurization system may comprise a first control valve comprising a throttling valve that modulates the gas flow, head temperature, and outlet pressure, a second control valve comprising a bypass valve for unloading the check valve train, a third control valve comprising a gas inlet temperature control valve, and a fourth control valve that is the second stage inlet temperature control.

According to aspects illustrated herein, there is provided a gas transport and pressurization system comprising a ram assembly. The ram assembly is a ram-type compression pump. The internal valve train of the gas transport and pressurization system has no moving parts, and the internal checking action is capable of being modulated via external valve operations for the purposes of flow control, pressure control, temperature control, and dew point control. Gas from the ground is fed through a double wall head, arranged around a first static one-way valve and controls head temperatures. After passing through the double wall head, the gas flows through the center of the piston or pump and into a dynamic reciprocating one way-valve. The dynamic one-way valve "rams" the gas therein into the static one-way valve repetitively, thereby pressurizing the gas. This leads to increased gas temperature in the static one-way valve, which is reduced via the flow of cooler gas through the double wall head. This ram-type compressor/pump does not require blowdown operations at start up and instrumentation may vary depending on application.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1A:
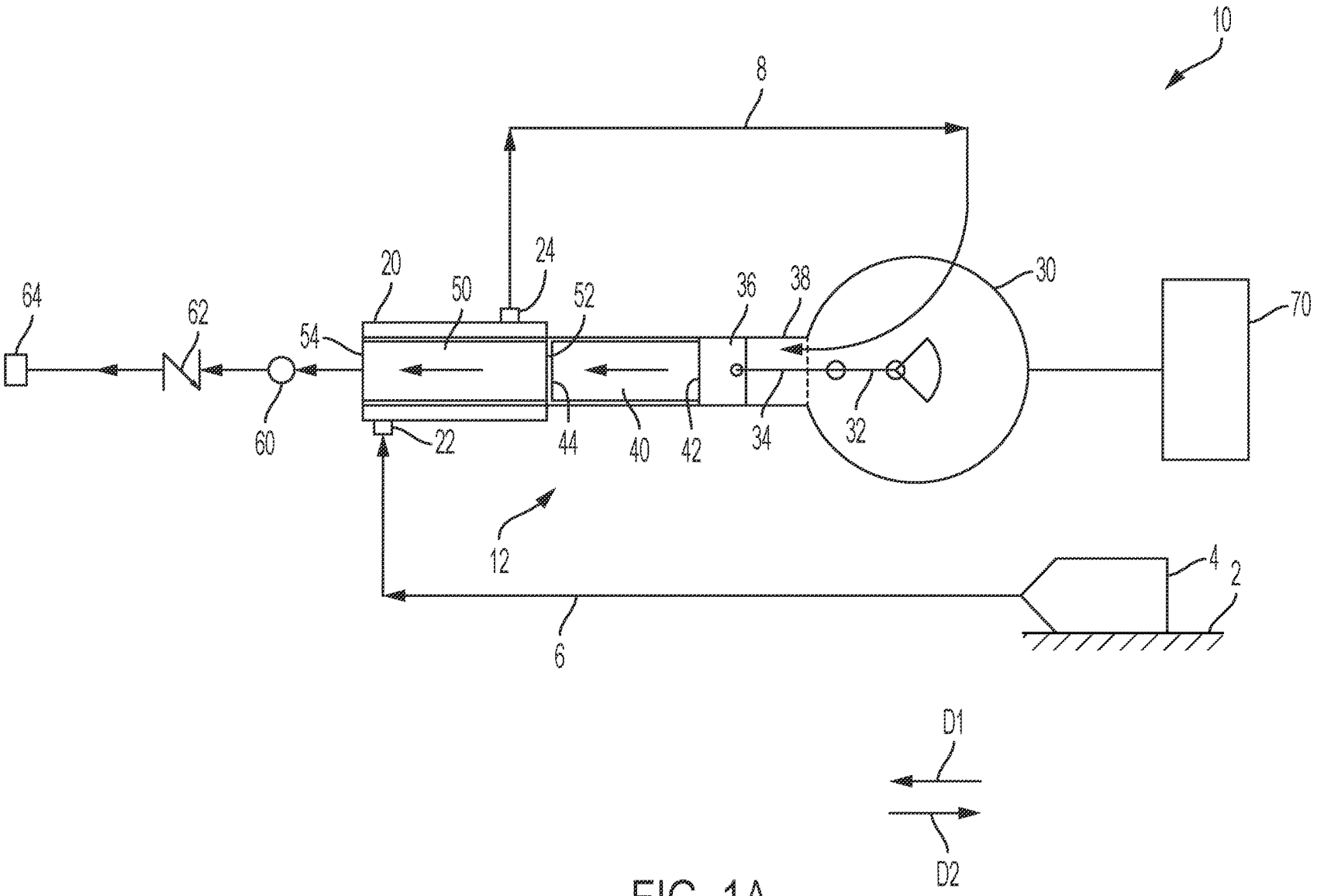
FIG. 1A is schematic view of a gas transport and pressurization system in a first state.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Figure 1B:
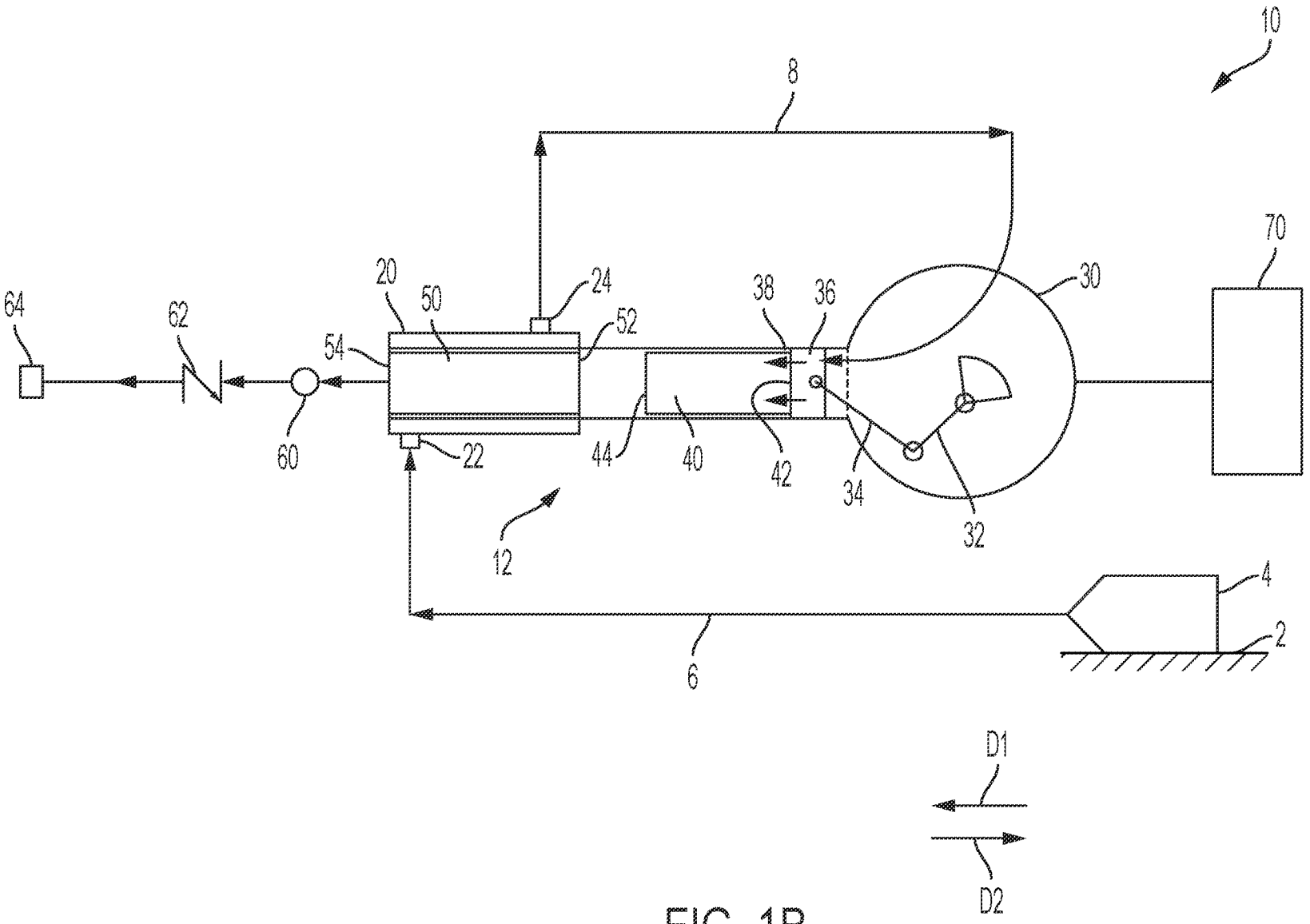
FIG. 1B is a schematic view of the gas transport and pressurization system shown in FIG. 1A in a second state.
Figure 2A:
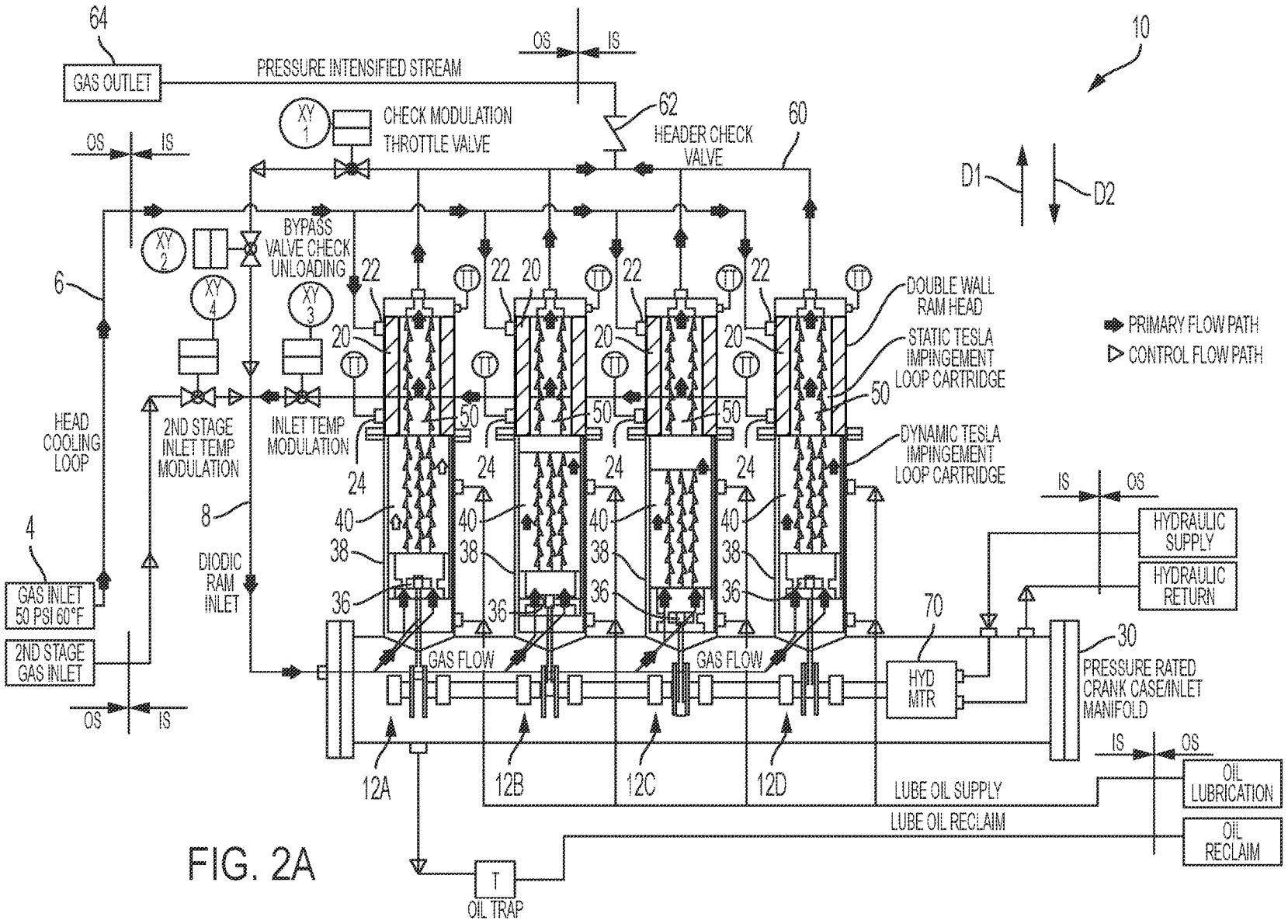
FIG. 2A is a front elevational schematic view of a gas and transport and pressurization system; and, FIG. 2B is a side elevational schematic view of the gas and transport and pressurization system shown in FIG. 2A.
Figure 2B:
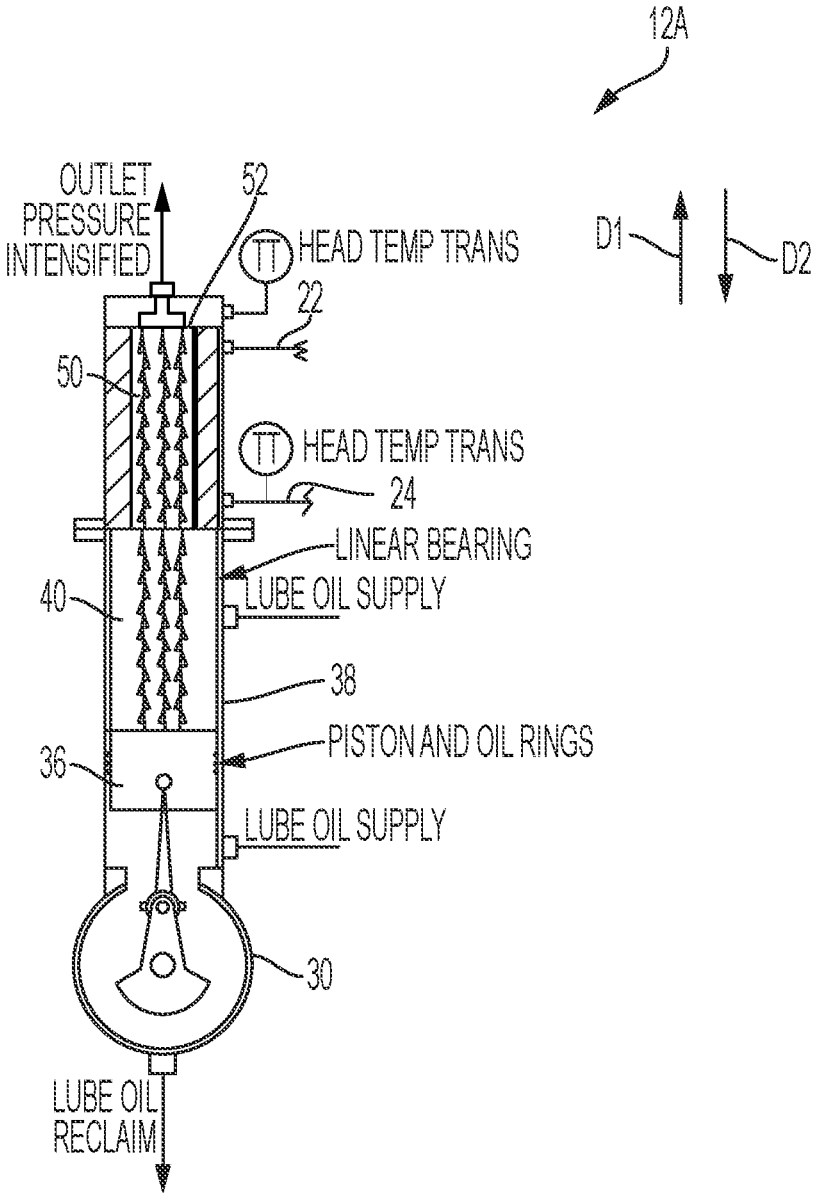

Referring now to the figures, FIG. 1A is schematic view of gas transport and pressurization system 10 in a first state, namely, with dynamic one-way valve 40 in a fully compressed state. FIG. 1B is a schematic view of gas transport and pressurization system 10, in a second state, namely, with dynamic one-way valve 40 in a fully charged state. FIG. 2A is a front elevational schematic view of gas and transport and pressurization system 10. FIG. 2B is a side elevational schematic view of gas and transport and pressurization system 10. Gas transport and pressurization system or system 10 generally comprises ram assembly, crank and/or crankcase 30, and motor 70. The following description should be read in view of FIGS. 1A-2B.

In some embodiments, gas is released from ground 2 via gas well 4 by any means known in the art. Gas is fed to ram assembly 12 from gas well 4 via conduit or piping 6. Ram assembly 12 generally comprises crankcase 30, dynamic valve 40, and static valve 50 (see FIG. 2B). Specifically, gas first enters compartment 20. Compartment 20 generally comprises two concentrically arranged cylinders sealingly connected at either end by a side wall to form a cylindrical sleeve compartment concentrically arranged around static valve 50. Compartment 20 comprises inlet 22 connected to conduit 6 and outlet connected to conduit 8. Gas flows from ground 2, into compartment 20 via inlet 22, and out of compartment 20 via outlet 24. Since gas flowing from ground 2 is generally much cooler than the compressed gas within static valve 50 (e.g., 60° F. at 50 psi), gas flow through compartment 20 results in the cooling of the compressed gas within static valve 50. Gas exits compartment 20 and flows to crankcase or inlet manifold 30 via conduit 8. In some embodiments, system 10 comprises temperature sensor and transmitter TT operatively arranged at outlet 24 to detect the temperature of the gas at outlet 24 and to transmit that temperature to a remote location, for example, to a controller or one or more control valves (see FIGS. 2A-B). In some embodiments, and as shown in FIG. 2A, system 10 comprises control valve XY3 fluidly arranged between outlet 24 and crankcase 30 (i.e., in conduit 8). Control valve XY3 is operatively arranged to control the temperature of the gas entering crankcase 30. Control valve XY3 is operatively arranged to regulate the amount of gas entering crankcase 30 from outlet 24. Since gas flowing from outlet 24 may have a high temperature, it is desired to regulate that temperature such that it is lower prior to entering crankcase 30. As such, control valve XY3, and control valve XY4 as will be described in greater detail below, regulates the flow of gas from outlet 24 to crankcase 30 thereby regulating the temperature of gas flow to crankcase 30. In some embodiments, control valve XY3 comprises a throttling valve.

Crankcase 30 is a pressure rated crankcase and sealingly connected to cylinder 38. Crankcase 30 comprises crankshaft 32 and piston rod 34. Piston 36 is slidingly engaged in cylinder 38 and is connected to piston rod 34. Crankshaft 32 is rotated within crankcase 30 via motor 70. In some embodiments, motor 70 is a hydraulic motor connected to a hydraulic fluid supply and a hydraulic fluid return (see FIG. 2A). Hydraulic fluid flows into hydraulic motor 70 from the hydraulic fluid supply, and out of hydraulic motor 70 back to the hydraulic fluid return. Hydraulic motor 70 converts the hydraulic pressure and flow into toque and angular displacement (rotation), thereby rotating crankshaft 32. The speed of hydraulic motor 70 is adjustable (i.e., faster or slower). In some embodiments, hydraulic motor 70 is arranged outside of crankcase 30 (see FIGS. 1A-B). In some embodiments, hydraulic motor 70 is arranged inside of crankcase 30 (see FIG. 2A). In some embodiments, lube oil is supplied to crankcase 30. In some embodiments, lube oil is supplied to cylinder 38. In some embodiments, crankcase 30 and/or cylinder 38 is connected to a lube oil reclaim. In some embodiments, the lube oil reclaim comprises oil trap T.

As crankshaft 32 is rotated within crankcase 30, piston rod 34 converts the angular displacement into linear activation of piston 36. Piston 36 displaces linearly in direction D1 and direction D2. Piston 36 is slidingly and sealingly engaged with cylinder 38. In some embodiments, piston 36 comprises oil or piston rings radially arranged between piston 36 and cylinder 38. Piston 36 comprises at least one one-way valve. Gas flows from conduit 8 and into crankcase 30. The gas is directed through the one-way valve in piston 36, or into the cylinder just aft of piston 36 (see FIGS. 1A-B). As dynamic vale 40 is displaced in direction D1, gas is pulled into cylinder 38 and crankcase 30 (see FIG. 1A). As dynamic valve 40 is displaced in direction D2, the gas flows through the one-way valve in piston 36 and into dynamic valve 40. It should be appreciated that the one-way valve in piston 36 allows gas to flow through piston 36 in direction D1, but not in direction D2. It should also be appreciated that the one-way valve need not be located on piston 36. Instead, and in some embodiments, a one-way valve is arranged in crankcase 30. In such embodiments, and as shown in FIG. 2A, displacement of piston 36 in direction D1 pulls, by way of vacuum, gas into pressurized crankcase 30, and displacement of piston 36 in direction D2 transfers gas from crankcase 30 to dynamic valve 40. This process continues repetitively.

Dynamic valve 40 is connected to piston 36 such that as piston 36 displaces in directions D1 and D2, valve 40 displaces in directions D1 and D2. As such, dynamic valve is referred to a s a reciprocating valve. Dynamic valve comprises end 42 connected to piston 36 and end 44 directed toward static valve 50. Dynamic valve 40 is fluidly connected to the one-way valve of piston 36. As gas flows through piston 36 from crankcase 30, it enters dynamic valve 40. In some embodiments, dynamic valve 40 comprises one or more valvular conduits, for example, the valvular conduit disclosed in U.S. Pat. No. 1,329,559 (Tesla), which patent is incorporated herein by reference in its entirety. As disclosed in Tesla, a valvular conduit comprises a plurality of impingement loops and center channels that allow fluid (i.e., gas) to flow in a first direction but not a second direction. Dynamic valve 40 comprises one or more valvular conduits (see FIGS. 2A-B) that allow gas to travel therein in direction D1 but not in direction D2. It should be appreciated that dynamic valve 40 may comprise any suitable one-way valve. It should also be appreciated that the use of one or more valvular conduits in dynamic valve 40 provides the desired gas pressurization of the present disclosure. In some embodiments, a linear bearing is arranged between cylinder 38 and dynamic valve 40.

As previously described, as piston 36 displaces in direction D2, gas flows through piston 36 and into the valvular conduits of dynamic valve 40 via end 42. Gas already arranged in the valvular conduits of dynamic valve 40 flows out of end 44 of dynamic valve 40 (i.e., the gas remains in cylinder 38 between ends 44 of dynamic valve 40 and end 52 of static valve 50). As piston 36 displaces in direction D1, dynamic valve 40 "rams" gas forward thereof into static valve 50. This can be thought of as collecting or loading gas, as piston 36 and dynamic valve 40 displace in direction D2, and pushing or ramming gas, as piston 36 and dynamic valve 40 displace in direction D1.

In some embodiments, piston 36 is arranged concentrically around dynamic valve 40, and end 42 of dynamic valve 40 is open to crankcase 30. In such embodiments, dynamic valve 40 is sealingly and slidingly connected to piston 36. Thus, there is no need for a one-way valve within piston 36, as the one or more valvular conduits or one-way valves in dynamic valve 40 operate to allow gas flow through dynamic valve 40 in direction D1 only.

Static valve 50 is fixed relative to cylinder 38. In some embodiments, static valve 50 is sealingly connected to cylinder 38. Static valve 50 comprises end 52 directed toward dynamic valve 40 and end 52 through which gas exits ram assembly 12. Similar to dynamic valve 40, static valve 50 comprises one or more valvular conduits. As dynamic valve 40 displaces in direction D1, it forces gas in cylinder 38 into the valvular conduits of static valve 50 via end 52. Gas that was already in the valvular conduits of static valve 50 is forced out of static valve 50 at end 54. This process continuously repeats as dynamic valve 40 reciprocates. It should be appreciated that static valve 50 may comprise any suitable one-way valve. It should also be appreciated that the use of one or more vascular conduits in static valve 50 provides the desired gas pressurization of the present disclosure. In some embodiments, system 10 comprises temperature sensor and transmitter TT operatively arranged at end 54 to detect the temperature of the gas flowing out of static valve 50 and to transmit that temperature to a remote location, for example, to a controller or one or more control valves (see FIGS. 2A-B). According to the Ideal Gas Law, pressure is directly related to temperature. Thus, as previously descried, at a fixed volume, as pressure increases temperature increases. As such, as gas pressurizes in cylinder 38, dynamic valve 40, and static valve 50, the temperature thereof rises substantially. By running cooler gas from ground 2 through compartment 20, which is concentrically arranged around static valve 50, the gas within cylinder 38, dynamic valve 40, and static valve 50 can be cooled.

Gas flows from end 54 of static valve 50 and into header 60. Gas then flows through check valve 62 to gas outlet 64. Check valve 62 allows gas to flow in one direction only, from header 60 to gas outlet 64. In some embodiments, header 60 is connected to control valve XY1. Control valve XY1 is a throttling valve and modulates the gas flow, head temperature, and outlet pressure. By adjusting control valve XY1, the pressure and temperature within system 10 can be adjusted. Thus, when control valve XY1 is fully closed, system 10 will output the highest gas pressure and thus the highest gas temperature. When control valve XY1 is fully open, system 10 will output the lowest gas pressure and thus the lowest gas temperature. In some embodiments, control valve XY1 comprises throttling or glove valve. In some embodiments, header 60 is further connected to control valve XY2. Control valve XY2 is a bypass valve for unloading the check valve train. During startup of system 10, in order to dissipate high pressure therein, control valve XY2 is open (this unloads the forces on the reciprocating mechanisms). In some embodiments, control valve XY2 comprises a block or full port ball valve.

In some embodiments, system 10 may comprise a plurality of ram assemblies, for example, ram assemblies 12A-D as shown in FIG. 2A. The use of multiple ram assemblies is beneficial because a larger volume of gas can be pressurized. In such embodiments, ram assemblies 12A-D are connected to crankcase 30 and header 60. Ram assembles 12A-D operate exactly the same as described above. Ram assembly 12A shows piston 36 and dynamic ram 40 in full compression, namely, end 44 is arranged substantially proximate to or abuts against end 52. Ram assembly 12B shows piston 36 and dynamic ram 40 in half charge, namely, piston 36 and dynamic ram 40 are displaced in direction D2 from full compression and end 44 is spaced apart from end 52. Ram assembly 12C shows piston 36 and dynamic ram 40 in full charge, namely, end 44 is maximumly spaced apart from end 52. Ram assembly 12D shows piston 36 and dynamic ram 40 in half compression, namely, piston 36 and dynamic ram 40 are displaced in direction D1 from full charge and end 44 is spaced apart from end 52.

In some embodiments, gas from a second stage gas inlet flows into crankcase 30 (see FIG. 2A). The second stage gas inlet comprises low temperature gas, for example, from a cryogenic vapor receiver. In some embodiments, system 10 further comprises control valve XY4 fluidly connected between the second stage gas inlet and crankcase 30. Control valve XY4 is the second stage inlet temperature control. Control valve XY4 is operatively arranged to regulate the amount gas from the second stage gas inlet that is fed to crankcase 30. The gas from the second stage gas inlet is mixed with gas from outlet 24 in order to regulate the temperature of the gas entering crankcase 30. In some embodiments, control valve XY4 comprises a throttling valve.

It should be appreciated that gas inlet 4, the second stage gas inlet, the hydraulic fluid supply, the hydraulic fluid return, the oil lubrication supply, the oil lubrication return, are all components arranged in outside system OS (see FIG. 2A). All other components of system 10 are arranged inside system IS. Furthermore, the primary flow path as shown in FIG. 2A, designates the flow path of gas from ground 2, through ram assemblies 12, 12A-D, and to gas outlet 64. The control flow path represents the gas temperature modulation elements such as control valves, as well as the oil lubrication system, and the hydraulic fluid supply system, namely, the systems used to act upon the gas flow in system 10.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

2 Ground
4 Gas well
6 Conduit
8 Conduit
10 Gas transport and pressurization system
12 Ram assembly
12A Ram assembly
12B Ram assembly
12C Ram assembly
12D Ram assembly
20 Compartment
22 Inlet
24 Outlet
30 Crankcase or inlet manifold
32 Crankshaft
34 Piston rod
36 Piston
38 Cylinder
40 Reciprocating dynamic one-way valve
42 End
44 End
50 Static one-way valve
52 End
54 End
60 Header
62 Check valve
64 Gas outlet
70 Motor or hydraulic motor
D1 Direction
D2 Direction
T Oil trap
TT Temperature sensor and/or temperature transmitter
XY1 Control valve
XY2 Control valve
XY3 Control valve
XY4 Control valve

What is claimed is:

1. A gas transport and pressurization system, comprising:
a static valve;
a compartment forming a first inlet to the gas transport and pressurization system, the compartment comprising a sleeve concentrically arranged around and axially aligned with the static valve;
a dynamic valve axially displaceable relative to the static valve; and,
a crankshaft connected to the dynamic valve;
wherein gas from a ground gas well flows through the compartment, the dynamic valve, and the static valve to a gas outlet.

2. The gas transport and pressurization system as recited in claim 1, further comprising a cylinder, the dynamic valve being sealingly and slidingly engaged in the cylinder.

3. The gas transport and pressurization system as recited in claim 2, wherein the dynamic valve allows gas flow therethrough in a first direction, but not a second direction.

4. The gas transport and pressurization system as recited in claim 3, wherein the static valve allows gas flow therethrough in the first direction, but not the second direction.

5. The gas transport and pressurization system as recited in claim 2, further comprising a crankcase connected to the cylinder, the crankshaft being arranged in the crankcase, wherein the gas flows through the crankcase prior to entering the dynamic valve.

6. The gas transport and pressurization system as recited in claim 5, further comprising a hydraulic motor connected to the crankshaft, the hydraulic motor operatively arranged to rotate the crankshaft and reciprocate the dynamic piston valve in a first direction and a second direction, opposite the first direction.

7. The gas transport and pressurization system as recited in claim 5, wherein:
when the dynamic valve is displaced in the first direction: gas in the cylinder is forced into the static valve; and, gas from the compartment is pulled into the crankcase; and,
when the dynamic valve is displaced in the second direction, gas from the crankcase is forced into the dynamic valve.

8. The gas transport and pressurization system as recited in claim 5, further comprising a first control valve fluidly arranged between the compartment and the crankcase, the first control valve operatively arranged to regulate the flow of gas therethrough.

9. The gas transport and pressurization system as recited in claim 8, further comprising a second control valve fluidly arranged between a second gas inlet and the crankcase, the second control valve operatively arranged to regulate flow of gas therethrough.

10. The gas transport and pressurization system as recited in claim 1, wherein each of the static valve and the dynamic valve comprises at least one valvular conduit.

11. The gas transport and pressurization system as recited in claim 1, further comprising a temperature sensor and transmitter arranged on at least one of an outlet of the compartment and an outlet of the static valve.

12. A gas transport and pressurization system, comprising:

a static valve;

a compartment concentrically arranged around the static valve;

a cylinder connected to the static valve;

a dynamic valve sealingly and slidingly engaged in the cylinder, the dynamic valve axially displaceable relative to the static valve;

a crankcase connected to the cylinder; and, a crankshaft arranged in the crankcase and connected to the dynamic valve;

wherein gas from a ground gas well flows, in order, through the compartment, the crankcase, the dynamic valve, and the static valve to a gas outlet.

13. The gas transport and pressurization system as recited in claim 12, wherein the dynamic valve allows gas flow therethrough in a first direction, but not a second direction.

14. The gas transport and pressurization system as recited in claim 13, wherein the static valve allows gas flow therethrough in the first direction, but not the second direction.

15. The gas transport and pressurization system as recited in claim 12, further comprising a hydraulic motor connected to the crankshaft, the hydraulic motor operatively arranged to rotate the crankshaft and reciprocate the dynamic valve in a first direction and a second direction, opposite the first direction.

16. The gas transport and pressurization system as recited in claim 15, wherein:

when the dynamic valve is displaced in the first direction: gas in the cylinder is forced into the static valve; and, gas from the compartment is pulled into the crankcase; and, when the dynamic valve is displaced in the second direction, gas from the crankcase is forced into the dynamic valve.

17. The gas transport and pressurization system as recited in claim 12, further comprising a first control valve fluidly arranged between the compartment and the crankcase, the first control valve operatively arranged to regulate the flow of gas therethrough.

18. The gas transport and pressurization system as recited in claim 17, further comprising a second control valve fluidly arranged between a gas inlet and the crankcase, the second control valve operatively arranged to regulate flow of gas therethrough.

19. The gas transport and pressurization system as recited in claim 12, wherein each of the static valve and the dynamic valve comprises at least one valvular conduit.

20. A gas transport and pressurization system, comprising:

a static valve;

a compartment concentrically arranged around the static valve;

a cylinder connected to the static valve;

a dynamic valve sealingly and slidingly engaged in the cylinder, the dynamic valve axially displaceable relative to the static valve;

a crankcase connected to the cylinder;

a crankshaft arranged in the crankcase and connected to the dynamic valve;

a first control valve fluidly arranged between the compartment and the crankcase; and a second control valve fluidly arranged between a first gas inlet and the crankcase; wherein gas from a second gas inlet flows through the compartment the crankcase, the dynamic valve, and the static valve to a gas outlet.

* * * * *